United States Patent [19]

Whittaker et al.

[11] Patent Number: 5,018,720

[45] Date of Patent: May 28, 1991

[54] DOCUMENT TRANSPORT MODULE

[75] Inventors: Sean E. Whittaker, Brooktondale; Bruce F. Harris, Willseyville, both of N.Y.

[73] Assignee: NCR Corporation, Dayton, Ohio

[21] Appl. No.: 498,187

[22] Filed: Mar. 22, 1990

[51] Int. Cl.[5] ..... B65H 5/06

[52] U.S. Cl. ..... 271/272; 271/188; 271/209; 271/314

[58] Field of Search ..... 271/272, 273, 274, 314, 271/161, 188, 209

[56] References Cited

U.S. PATENT DOCUMENTS

| | | | |
|---|---|---|---|
| 3,109,924 | 11/1963 | Frederick | 271/272 X |
| 3,199,864 | 8/1965 | Irvine | 271/272 X |
| 3,523,687 | 5/1968 | Petersen et al. . | |
| 3,815,899 | 6/1974 | Hatzmann . | |
| 4,145,041 | 3/1979 | Kew | 271/188 X |
| 4,179,031 | 12/1979 | Ward . | |
| 4,197,023 | 4/1980 | DeBoo et al. . | |
| 4,353,543 | 10/1982 | Ikeda | 271/273 X |
| 4,482,057 | 11/1984 | Shawen et al. . | |
| 4,648,591 | 3/1987 | Osmera | 271/273 X |
| 4,718,783 | 1/1988 | Tsushima et al. . | |

*Primary Examiner*—Richard A. Schacher

*Attorney, Agent, or Firm*—Wilbert Hawk, Jr.; Albert L. Sessler, Jr.; Matthew R. Jenkins

[57] ABSTRACT

A document transport module for moving a document along a bidirectional feed line from an upstream area to a downstream area in, for example, an automated teller machine. The document transport module comprises first and second generally planar supports, with the first generally planar support having a first cooperating member and a second cooperating member located thereon. The first and second cooperating members each have ends which have ramp portions secured thereto. In addition, the first and second cooperating members each have an arcuately shaped recess therein which faces a second support. A document can be moved between the first and second supports and guided into the arcuately shaped recessed portions of the first and second cooperating members by the ramp portions. The ramp portions guide the document between the arcuately shaped recessed portions and a drive roller mounted in the second support. The drive roller, when rotated, forces or pinches the document into engagement with the arcuately shaped recessed portions, thereby causing the document to be transported through the document transport module.

13 Claims, 6 Drawing Sheets

DOCUMENT TRANSPORT MODULE

BACKGROUND OF THE INVENTION

1. Field of the Invention

This invention relates to a document transport module for moving a document from a first area to a second area, and more particularly, this invention relates to a document transport module which includes a cooperating member having an arcuately shaped recess therein which cooperates with a drive roller to move the document in the document transport module from the first area to the second area.

2. Description of Related Art

Many business machines, like printers, include document feeding mechanisms. For example, Automated Teller Machines (ATM's), which are used in the banking industry, include a receipt printer which is used to print transaction information on a receipt document. The document is fed or transported in a document track from the printer to a slot in the face of the ATM where it can be easily retrieved by a customer. Typically, the document track includes a pinch roller which forces or "pinches" the document against a drive roller. The document is then moved in the document track by causing the drive roller to rotate.

A problem with the arrangement described above is that it can require the use of numerous parts, such as a pivot or swing arm, springs, and bearings, which are expensive. Another problem is that the friction between the pinch roller and the drive roller may cause excessive wear and tear on both the drive roller and the pinch roller. Yet another problem is that the pinch roller may require a significant amount of space in the ATM.

There is, therefore, a present need to provide a document transport which eliminates the use of a pinch roller, which reduces wear and tear on the drive roller, and which is simple in design.

SUMMARY OF THE INVENTION

In one aspect of the invention, there is provided a document transport module for moving a document from an upstream area to a downstream area, said document transport module comprising: first and second supports; said first and second supports each being generally planar and each having first and second ends; a cooperating member located on the first support, said cooperating member having an arcuately shaped recessed portion therein which faces the second support; drive means located on the second support for moving the document into engagement with the arcuately shaped recessed portion and also for moving the document in the document transport module to the downstream area; pivot means for pivotally securing the first ends of the first and second supports together; said pivot means enabling the first and second supports to pivot between an open position and a closed position such that, when the first and second supports are in the closed position, said drive means can move the document into engagement with the arcuately shaped recessed portion; and securing means associated with the second ends for securing the first and second supports in the closed position.

A primary object of this invention is to provide a means for transporting a document which eliminates the need for pinch rollers.

Another object of this invention is to provide a document transport module comprising at least one cooperating member having an arcuately shaped recess therein which forces a document against a drive roller.

Another object of this invention is to provide a document transport module which is easy and inexpensive to assemble and manufacture.

Yet another object of this invention is to provide a document transport module which is simple in design.

These objects and others will become more apparent from the following specification, claims, and drawing.

DESCRIPTION OF THE PREFERRED EMBODIMENT

Figure 1:
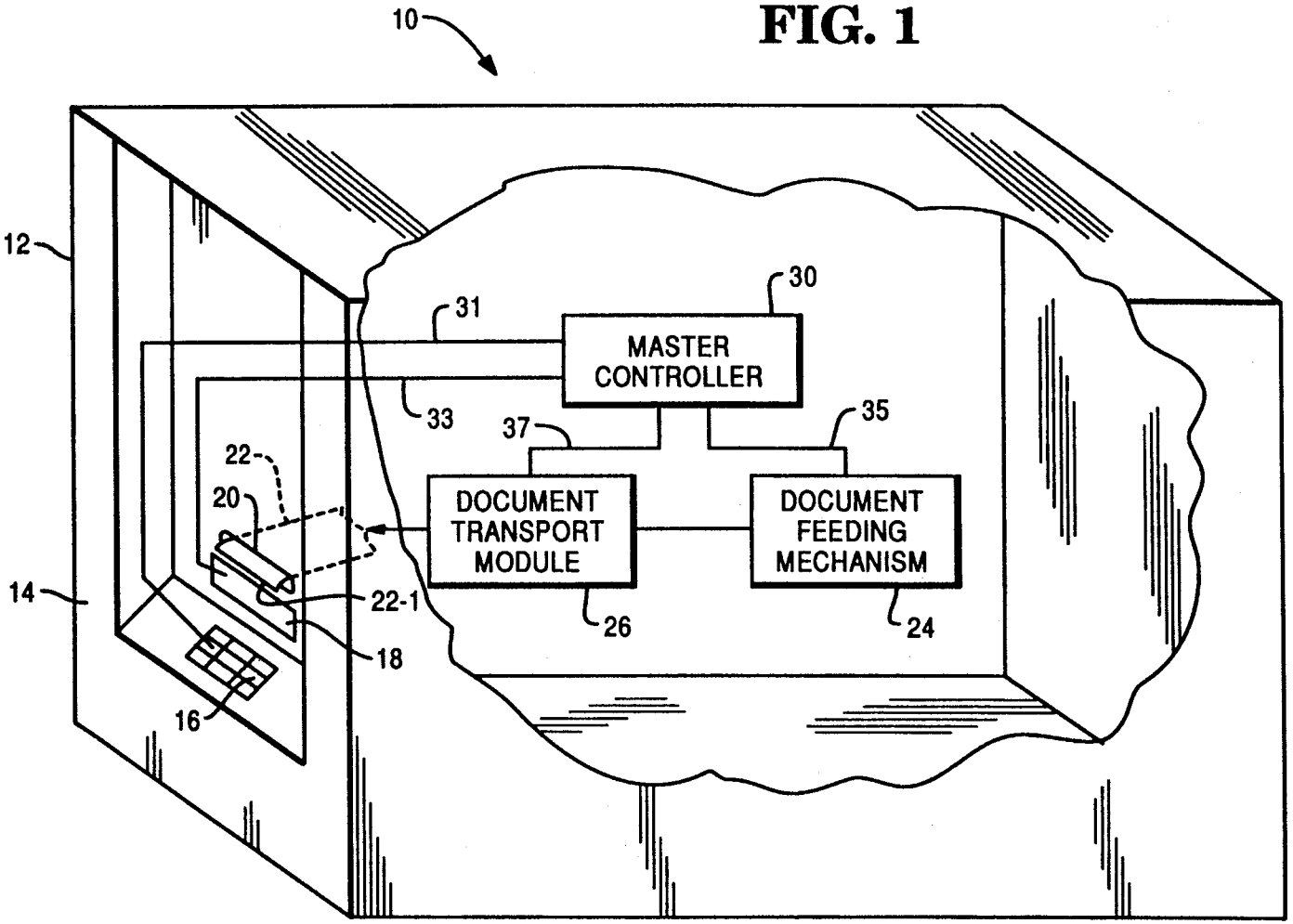
FIG. 1 is a general schematic view (partly broken away) of a portion of an automated teller machine having a document transport module made according to the present invention.

FIG. 1 is a general schematic view of a portion of an automated teller machine, hereinafter designated as ATM 10, in which a preferred embodiment of this invention may be used. The ATM 10 includes a housing 12 having a front panel 14 which includes a keyboard 16 and a display 18 and which enables the customer to operate the ATM 10. The front panel 14 includes a slot 20 through which a document 22, such as a receipt, can be passed to the customer. The ATM 10 also includes a document feeding mechanism 24 which may be part of a conventional printer (not shown), for example. The ATM 10 also includes a transport or document transport module 26 for transporting the document 22 from the document feeding mechanism 24 to the slot 20 in the front panel 14 of the ATM 10. The ATM 10 further includes a master controller 30 for receiving and for providing electrical signals for controlling the operation of the ATM 10. As best shown in FIG. 1, the master controller 30 is coupled to the keyboard 16, display 18, document feeding mechanism 24, and document transport module 26 by suitable conductors 31, 33, 35, and 37, respectively. Two typical ATM's are disclosed in U.S. Pat. No. 4,179,031 and U.S. Pat. No. 4,478,057, which are assigned to the assignee of the present application and which can be referred to for a discussion of the general construction and operation of an ATM, such as the ATM 10.

Figure 2:
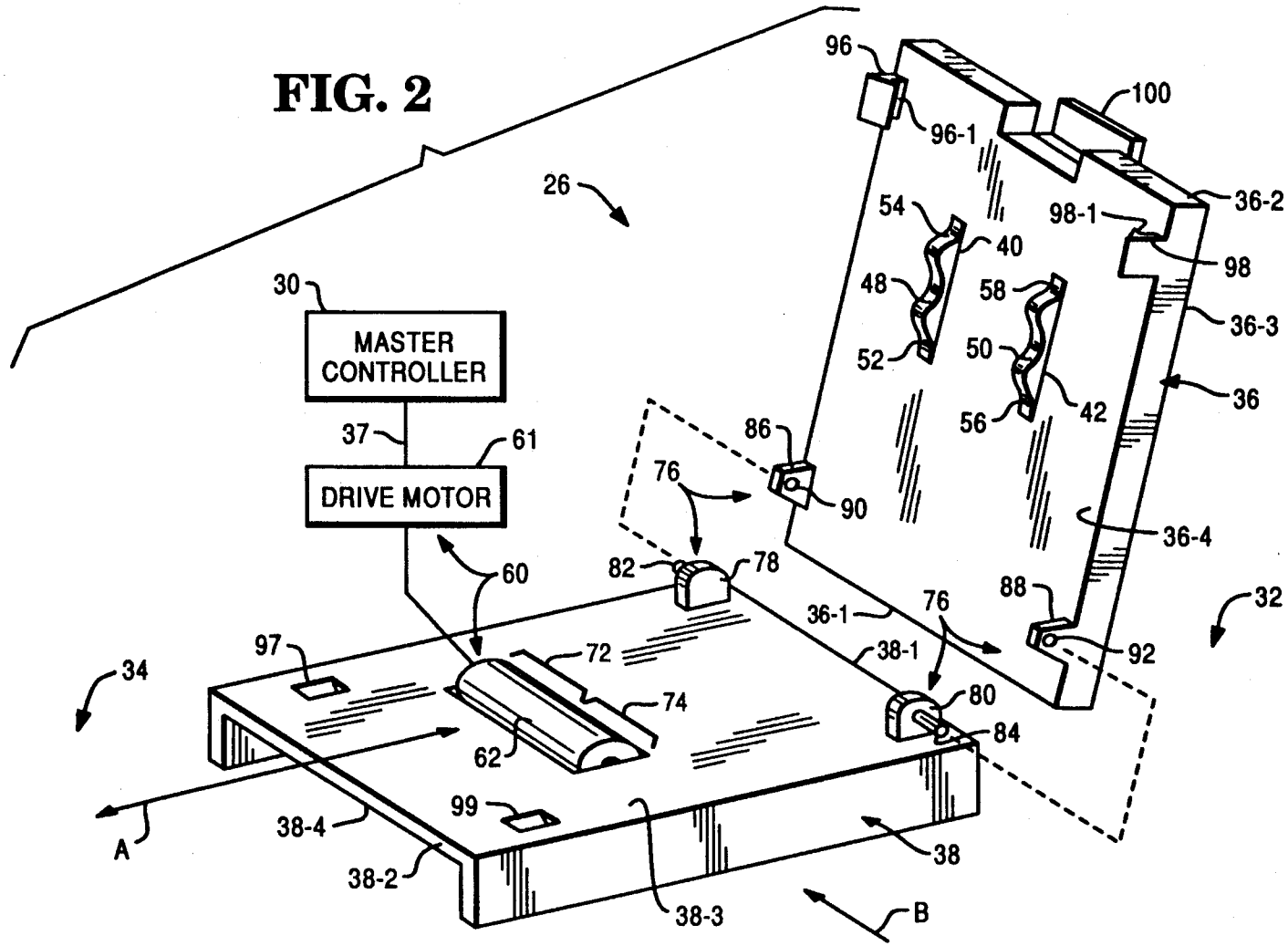
FIG. 2 is an exploded isometric view of the document transport module of FIG. 1, with the module including first and second supports, drive means on the second support, and first and second cooperating members on the first support.
Figure 3:
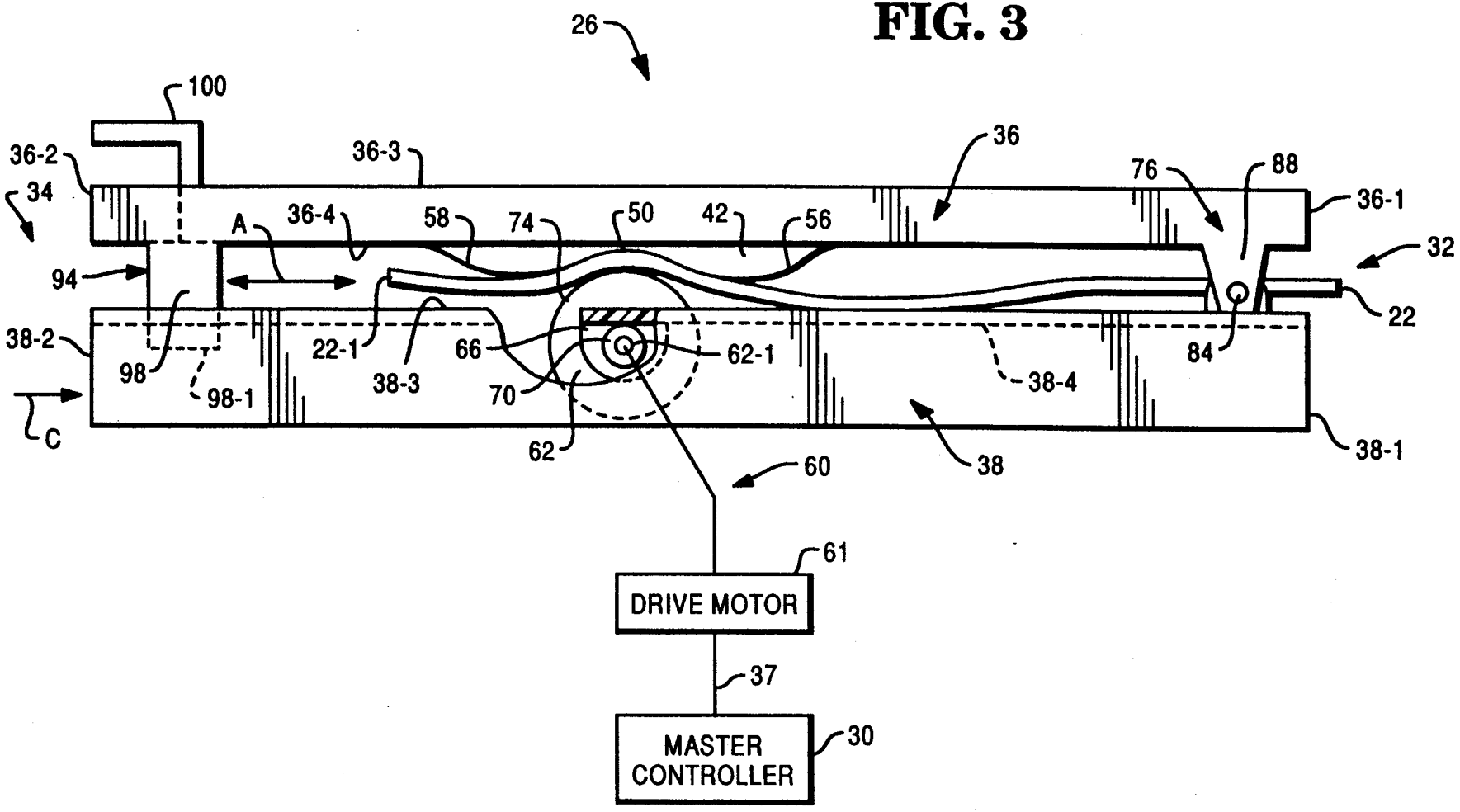
FIG. 3 is an assembled side view of the document transport module when looking in the direction of arrow B of FIG. 2, showing the drive roller forcing a document into driving engagement with the second cooperating member.

A preferred embodiment of the document transport module 26 of this invention is shown in FIGS. 2 through 5. The function of the document transport module 26 is to transport or move the document 22 along a bidirectional feed line, indicated by arrow A in FIGS. 2 and 3. As best shown in FIG. 3, document 22 is moved along the bidirectional feed line A from a first area 32 to a second area 34. Typically, the first area 32 becomes the upstream area because the document feeding mechanism 24 is located there, and the second area 34 becomes the downstream area because the slot 20 (FIG. 1) is located there. However, the document 22 may be moved from the second area 34 to the first area 32 in which case the second area 34 becomes the upstream area and the first area 32 becomes the downstream area. This may occur when, for example, the document 22 is inserted into the slot 20 from the front panel 14 of the ATM 10 so as to enable a field engineer or service person to print data on the document 22 during maintenance or repair.

As illustrated in FIG. 2, the document transport module 26 includes a first support 36 and a second support 38. In a preferred embodiment, the first support 36 and second support 38 are generally planar and each of them is molded from plastic. As shown in FIG. 3, the first support 36 includes a first end 36-1, a second end 36-2, a top surface 36-3, and a bottom surface 36-4. The second support 38 includes a first end 38-1, a second end 38-2, a top surface 38-3, and a bottom surface 38-4.

The first support 36 (FIG. 2) includes a first cooperating member 40 and a second cooperating member 42. The first and second cooperating members 40 and 42 may be molded as part of the first support 36. The first cooperating member 40 lies in a first plane 44 (FIG. 4) and the second cooperating member 42 lies in a second plane 46, with the planes 44 and 46 being generally parallel to each other and generally perpendicular to the plane of the first support 36. As best shown in FIG. 2, the first cooperating member 40 includes a first arcuately shaped recessed portion 48, and the second cooperating member 42 includes a second arcuately shaped recessed portion 50. The first and second arcuately shaped recessed portions 48 and 50 face the top surface 38-3 of the second support 38 when the first and second supports 36 and 38 are in the assembled relationship shown in FIGS. 3 and 4. The first cooperating member 40 includes a first ramp portion 52 and a second ramp portion 54 which are located on opposite ends of the first cooperating member 40. Likewise, the second cooperating member 42 includes a third ramp portion 56 and a fourth ramp portion 58 which are located on opposite ends of the second cooperating member 42. The first ramp portion 52 is angled or sloped from the first bottom surface 36-4 of the first support 36 to the arcuately shaped recessed portion 48. The ramp portions 54, 56, and 58 are angled or sloped in a similar manner as shown. The function and operation of the first, second, third and fourth ramp portions 52, 54, 56, and 58 will be described later herein.

Figure 4:
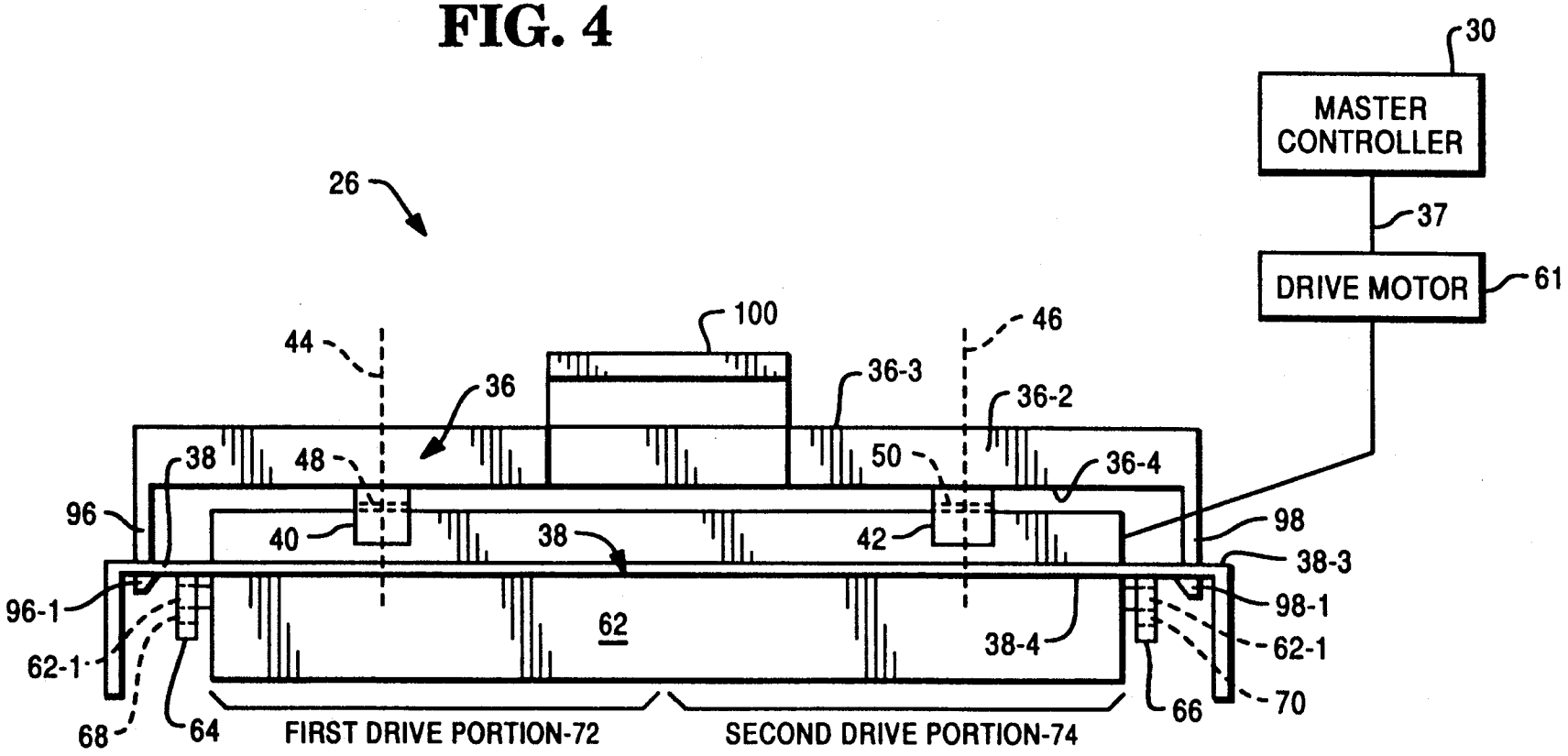
FIG. 4 is a front view of the document transport module, when looking in the direction of arrow C in FIG. 3, showing a first drive portion and a second drive portion of the drive roller included in the drive means.

The document transport module 26 also includes drive means 60 (FIG. 2) which is associated with the second support 38. The function of the drive means 60 is to drive the document 22 (FIG. 3) into driving engagement with the first and second cooperating members 40 and 42 so as to cause the document 22 to move in the document transport module 26 along the bidirectional feed line A. As illustrated in FIG. 4, the drive means 60 includes a cylindrically-shaped drive roller 62 having a cylindrical axle 62-1 extending from opposite ends thereof. The second support 38 includes a first flange 64 and a second flange 66 which depend from the bottom surface 38-4 of the second support 38 in an opposed relationship to each other. The first flange 64 includes a first roller bearing 68 and the second flange 66 includes a second roller bearing 70 which rotatably support the cylindrical axle 62-1 so that the first drive roller 62 is rotatably mounted on the second support 38. The drive means 60 also includes conventional gears (not shown) and linkage (not shown) which couple the drive roller 62 to a drive motor 61, such as a stepper motor. The master controller 30 can energize the drive motor 61 to cause the drive roller 62 to rotate in either clockwise or counterclockwse direction, as shown by double arrow D in FIG. 5. When, for example, the drive roller 62 is rotated in a counterclockwise direction, the document 22 is moved from the upstream area 32 (FIGS. 2 and 3) to the downstream area 34 along the bidirectional feed line A.

Figure 5:
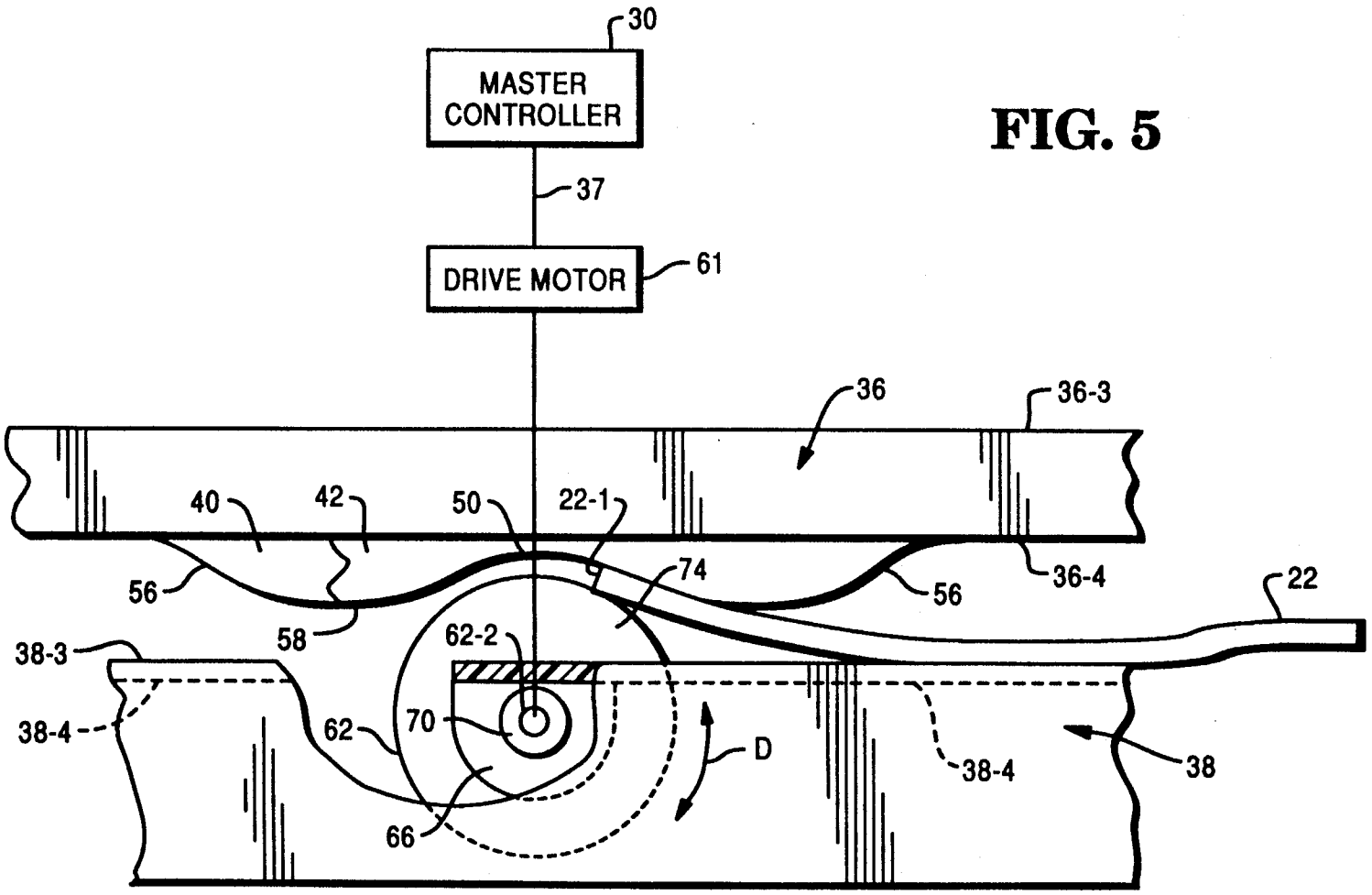
FIG. 5 is an enlarged view of FIG. 3, showing additional details of how a ramp on the second cooperating member cooperates with the drive roller to move the document against the arcuately shaped recessed portion of the second cooperating member.

As best illustrated in FIG. 4, the drive roller 62 includes a first drive portion 72 and a second drive portion 74. The first and second arcuately shaped recessed portions 48 and 50 (FIG. 2) generally conform to the cylindrical shape of the first and second drive portions 72 and 74, respectively. In the embodiment being described, the radius of curvature of the first and second arcuately shaped recessed portions 48 and 50 is 1.3 times larger than the radius of curvature of the first and second drive portions 72 and 74, respectively. The first and second drive portions 72 and 74 become operatively coupled to the first and second cooperating members 40 and 42, respectively, when the first support 36 is moved from the open position shown in FIG. 2 to the closed position shown in FIG. 3. In order to move the document 22 in the feeding direction from the first area 32 to the second area 34, the document feeding mechanism 24 (FIG. 1) moves the document 22 up the first and third ramp portions 52 and 56. The first ramp portion 52 (FIG. 2) cooperates with the first drive portion 72 of drive roller 62 to guide the document 22 into the first arcuately shaped recessed portion 48. Likewise, the third ramp portion 56 cooperates with the second drive portion 74 to guide the document 22 into the second arcuately shaped recessed portion 50. As best illustrated in FIG. 5, a leading edge 22-1 of document 22 contacts a portion of the drive roller 62. The master controller 30 energizes the drive motor 61 to rotate the drive roller 62 in a counterclockwise direction (as viewed in FIG. 5), for example, thereby moving the document 22 along the bidirectional feed line A from the first area 32 to the second area 34. Notice that if the drive roller 62 is moved in a clockwise direction (as viewed in FIG. 5) by the drive motor 61, the document 22 is moved along the bidirectional feed line A from the second area 34 towards the first area 32. In this regard, the second ramp portion 54 (FIG. 2) cooperates with the first drive portion 72 of drive roller 62 and the fourth ramp portion 58 cooperates with the second drive portion 74 of drive roller 62 to guide the document 22 to the first and second arcuately shaped recessed portions 48 and 50, respectively. In order to avoid ripping the document 22 when the document transport module 26 and document feeding mechanism 24 are moving the document 22 at the same time, the drive roller 62 in the document transport module 26 may be a conventional "soft" drive roller (not shown) which permits the roller 62 to slip on the document 22.

As best shown in FIG. 2, the document transport module 26 includes pivot means 76 for pivotally securing the first end 36-1 of the first support 36 to the first end 38-1 of the second support 38. The pivot means 76 includes a third flange 78 and a fourth flange 80 which extend from the second support 38. As illustrated, the third flange 78 and fourth flange 80 include a first cylindrical stud 82 and a second cylindrical stud 84, respectively. The pivot means 76 also includes a first mounting support 86 having a first aperture 90 therein and a second mounting support 88 having a second aperture 92 therein. The first and second mounting supports 86 and 88 depend from the bottom surface 36-4 of the first support 36, as shown. The first and second mounting supports 86 and 88 are mounted on the first and second cylindrical studs 82 and 84 by slightly bending the first and second mounting supports 86 and 88 away from each other so that the first and second cylindrical studs 82 and 84 can be inserted in the apertures 90 and 92, respectively. When released, the first and second mounting supports 86 and 88 pivotally secure the first end 36-1 of the first support 36 to the first end 38-1 of the second support 38. The first and second supports 36 and 38 can be pivoted away from each other to an open position (shown in FIG. 2) or towards each other to a closed position (shown in FIGS. 3 and 4). As best shown in FIG. 4, when the first and second supports 36 and 38 are in the closed position, the first and second drive portions 72 and 74 of drive roller 62 become operatively positioned relative to the first and second arcuately shaped recessed portions 48 and 50, respectively. This enables the first and second drive portions 72 and 74 to move the document 22 into driving engagement with the first and second cooperating members 40 and 42, respectively.

The document transport module 26 further includes securing means, designated generally as 94 in FIG. 3, for securing the second end 36-2 of the first support 36 to the second end 38-2 of the second support 38. The securing means 94 includes a first resilient detent 96 (FIG. 2) and a second resilient detent 98 which depend from the bottom surface 36-4 of the first support 36. The second support 38 has a first opening 97 and a second opening 99 which receive the first resilient detent 96 and second resilient detent 98, respectively. The first resilient detent 96 has a shoulder 96-1 and the second resilient detent 98 has a shoulder 98-1. The first and second resilient detents 96 and 98 are initially moved or bent away from each other when they are forced into the first and second openings 97 and 99, respectively. The detents 96 and 98 subsequently move or bend toward each other, as best illustrated in FIG. 4, to permit the shoulder 96-1 and the shoulder 98-1 to engage the bottom surface 38-4 of the second support 38, thereby retaining the first and second supports 36 and 38 in the closed position.

As illustrated in FIGS. 2, 3, and 4, the preferred embodiment of the invention may include an L-shaped handle member 100 which is conventionally mounted on the top surface 36-3 of the second end 36-2 of the first support 36. The L-shaped handle member 100 provides a means for gripping the first support 36. In addition, the L shaped handle member 100 facilitates pivoting the second end 36 2 of the first support 36 away from the second end 38-2 of the second support 38. This feature permits, for example, easy removal of the document 22 if it becomes "jammed" between the first and second supports 36 and 38.

The operation of the document transport module 26 in an ATM 10 will now be described. During the course of a normal business transaction, it may be necessary to transport the document 22 from the document feeding mechanism 24 (FIG. 1) to the slot 20 in the front panel 14 of ATM 10 where the customer can receive the document 22. At the completion of a financial transaction, for example, the document 22 is outputted from the document feeding mechanism 24 located at the first area 32 and moved into the document transport module 26 until the document 22 lies between the first end 36-1 of the first support 36 and first end 38-1 of the second support 38. The document feeding mechanism 24 continues to move the document 22 along the bidirectional feed line A until the leading edge 22-1 of the document 22 contacts the first and third ramp portions 52 and 56. As the document feeding mechanism 24 moves the document 22 towards the second area 3 (FIG. 3), the leading edge 22-1 of document 22 is guided downwardly (as viewed in FIG. 3) along the first and third ramp portions 52 and 56 until the leading edge 22-1 contacts a portion of the drive roller 62, as best shown in FIG. 5. As the drive roller 62 rotates in a counterclockwise direction (as viewed in FIG. 5), the document 22 is "drawn" between the drive roller 62 and the first and second arcuately shaped recessed portions 48 and 50 (FIG. 2), respectively. The first and second arcuately shaped recessed portions 48 and 50 cooperate with the drive roller 62 to cause the document 22 to be shaped or deformed to the general shape of the drive roller 62. This causes the document 22 to become "pinched" against the drive roller 62. The master controller 30 continues to energize the drive motor 61 to rotate the drive roller 62 in the counterclockwise direction (as viewed in FIG. 3). This causes the document 22 to be moved along the bidirectional feed line A through the document transport module 26 towards the second area 34, as best illustrated in FIG. 3. The drive means 60 continues to incrementally move the document 22 downstream between the second end 36-2 of the first support 36 and second end 38-2 of the second support 38 until the leading edge 22-1 of the document 22 is moved through the slot 20 on the front panel 14 of the ATM 10, whereupon the customer can grasp the document 22.

Figure 6:
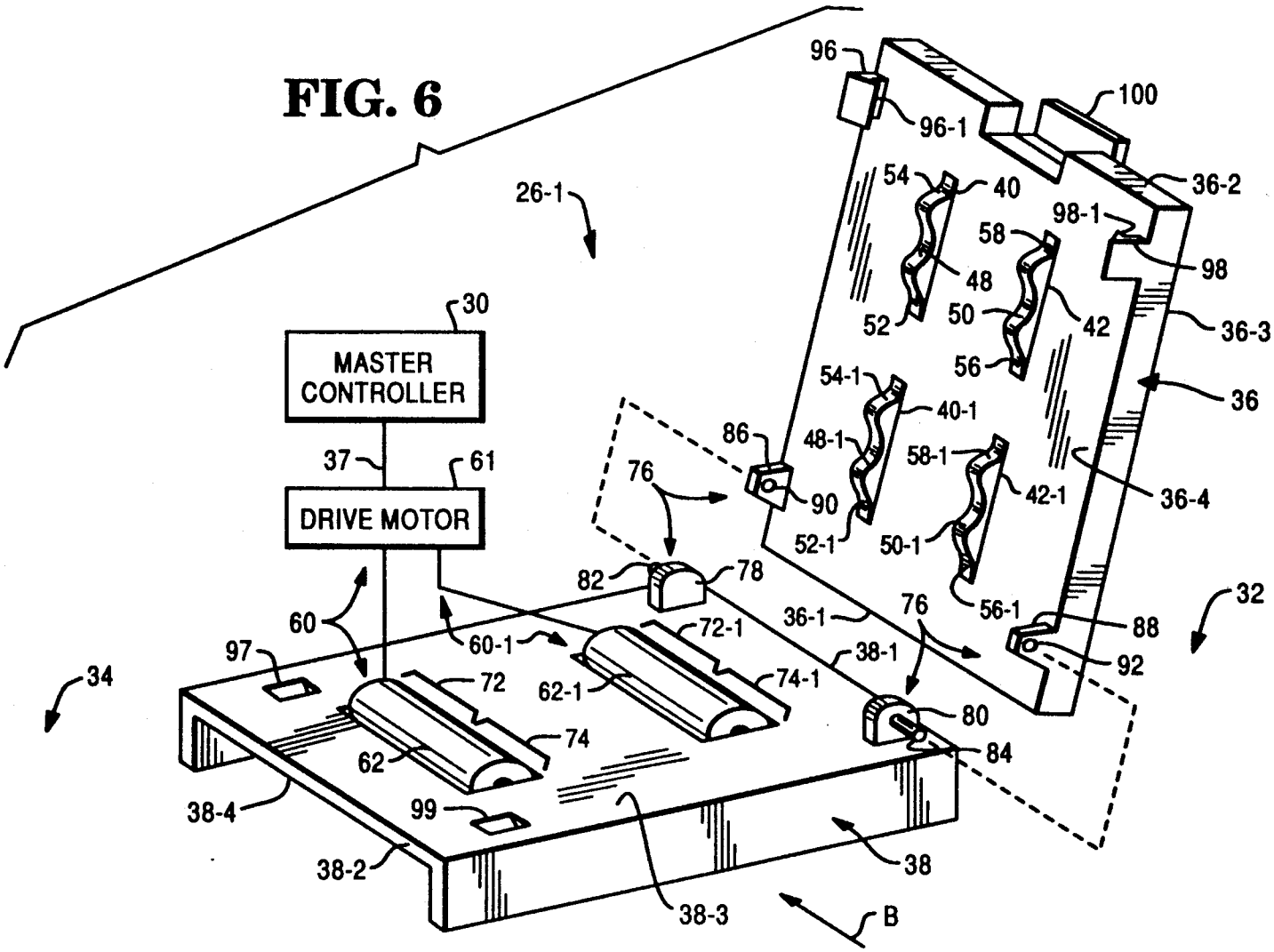
FIG. 6 is an exploded isometric view of a second embodiment of this invention, showing a second drive roller which engages third and fourth cooperating members on the first support.

FIG. 6 shows another embodiment of a document transport module which is designated generally as 26-1. Identical reference numbers in FIG. 6 and in FIG. 2 are used to indicate identical parts. Some parts shown in FIG. 6 have the same root number as the corresponding parts shown in FIG. 2, except that a "dash one" (−1) suffix has been added. These parts are similar to the parts shown in FIG. 2 which have identical root numbers, but these parts represent added parts. For example, the third cooperating member 40-1 shown in FIG. 6 is identical to the first cooperating member 40 shown in FIG. 2 and described earlier herein.

The document transport module 26-1 is identical to the document transport module 26 shown in FIG. 2, except that the document transport module 26-1 includes a third cooperating member 40-1, a fourth cooperating member 42-1, a third arcuately shaped recessed portion 48-1, a fourth arcuately shaped recessed portion 50-1, a fifth ramp portion 52-1, a sixth ramp portion 54-1, a seventh ramp portion 56-1, an eighth ramp portion 58 1, and drive means 60-1, including a drive roller 62-1 having a first drive portion 72-1 and a second drive portion 74-1. The third cooperating member 40-1 lies in the first plane 44 (FIG. 4) and is spaced from the first cooperating member 40. Likewise, the fourth cooperating member 42-1 lies :n the second plane 46 and is spaced from the second cooperating member 42. When used in a typical ATM 10, the cooperating members 40-1 and 42-1 are positioned on the first support 36 approximately 4 inches away from each other and approximately 2 inches (50.8 millimeters) away from the first and second cooperating members 40 and 42, respectively. The longitudinal axis of the second drive roller 62-1 is positioned approximately 3 inches (76.2 millimeters) away from the longitudinal axis of the first drive The document transport module 26-1 operates to move the document 22 therethrough in the same manner as described earlier herein in relation to the document transport module 26, except that this document transport module 26-1 further facilitates controlling the movement of document 22 therethrough. The two drive rollers 62 and 62-1 also facilitate proper alignment of document 22 when the document 22 exits the document transport module 26-1, and they also prevent the document 22 from becoming undesirably skewed therein.

Various changes or modifications in the invention described may occur to those skilled in the art without departing from the spirit or scope of the invention. For example, the first and second cooperating members 40 and 42 could be molded on the first support 36 as one continuous cooperating member (not shown) The above description of the invention is intended to be illustrative and not limiting, and it is not intended that the invention be restricted thereto but that it be limited only by the true spirit and scope of the appended claims.

What is claimed is:

1. A document transport module for moving a document from an upstream area to a downstream area, said document transport module comprising:

first and second supports;

a cooperating member located on said first support, said cooperating member having an arcuately shaped recessed portion therein which faces said second support;

drive means located on said second support for moving the document into engagement with said arcuately shaped recessed portion and also for moving the document in the document transport module to said downstream area;

said first and second supports being generally planar;

each of said first and second supports having first and second ends;

pivot means for pivotally securing said first ends of said first and second supports together; said pivot means enabling said first and second supports to pivot between an open position and a closed position such that, when said first and second supports are in said closed position, said drive means can move the document into engagement with said arcuately shaped recessed portion; and securing means associated with said second ends for securing the first and second supports in said closed position.

2. The document transport module as claimed in claim 1 in which said cooperating member further comprises:

first and second member ends located on said cooperating member relative to said upstream and downstream areas, respectively; and a first ramp portion located on said first member end of said cooperating member for guiding the document to said drive means.

3. The document transport module as claimed in claim 2 in which said cooperating member further includes a second ramp portion located on said second member end of said cooperating member.

4. The document transport module as claimed in claim 2 in which said drive means includes a drive roller for driving the document into engagement with said arcuately shaped recessed portion.

5. The document transport module as claimed in claim 4 in which said arcuately shaped recessed portion has a radius of curvature which is approximately 1.3 times the radius of curvature of said drive roller.

6. The document transport module as claimed in claim 4 in which said arcuately shaped recessed portion conforms generally in shape to a portion of said drive roller.

7. The document transport module as claimed in claim 1 in which said first support further includes a second cooperating member having an arcuately shaped recessed portion therein; and in which said drive means moves the document into simultaneous engagement with said arcuately shaped recessed portion of said cooperating member and said arcuately shaped recessed portion of said second cooperating member when the document is moved to said downstream area.

8. A document transport module for moving a document from an upstream area to a downstream area, said document transport module comprising:

first and second supports;

a cooperating member located on said first support, said cooperating member having an arcuately shaped recessed portion therein which faces said second support;

drive means located on said second support for moving the document into engagement with said arcuately shaped recessed portion and also for moving the document in the document transport module to said downstream area;

said first support further including a second cooperating member having an arcuately shaped recessed portion therein; and in which said drive means moves the document into simultaneous engagement with said arcuately shaped recessed portion of said cooperating member and said arcuately shaped recessed portion of said second cooperating member when the document is moved to said downstream area;

third and fourth cooperating members located on said first support, said third and fourth cooperating members each having an arcuately shaped recessed portion therein; and second means for moving the document into simultaneous engagement with said arcuately shaped recessed portions of said third and fourth cooperating members and also for moving the document to said downstream area.

9. A document transport for moving a document from an upstream area to a downstream area, said document transport comprising:

a first support member and a second support member;

a cooperating member located on said first support member, said cooperating member having an arcuately shaped recessed portion therein;

a drive roller located on said second support member for moving the document into engagement with said arcuately shaped recessed portion and also for moving the document to said downstream area;

said arcuately shaped recessed portion having a shape which conforms generally to a portion of said drive roller or said second drive roller;

said cooperating member further comprising:

first and second member ends located on said cooperating member relative to said upstream and downstream areas, respectively;

a first ramp potion and a second ramp portion located, respectively, on said first and second member ends of said cooperating member for guiding the document towards and away from said arcuately shaped recessed portion;

a second cooperating member having an arcuately shaped recessed portion therein;

said second cooperating member being located on said first support member so that, when said drive roller forces the document against said arcuately shaped recessed portion of said cooperating member, said drive roller simultaneously forces the document against said arcuately shaped recessed portion of said second cooperating member in order to move the document to said downstream area;

third and fourth cooperating members located on said first support, said third and fourth cooperating members each having an arcuately shaped recessed portion therein; and a second drive roller for moving the document into simultaneous engagement with said arcuately shaped recessed portions of said third and fourth cooperating members and also for moving the document to said downstream area.

10. The document transport as claimed in claim 9 in which the support member, said cooperating member, and said second, third and fourth cooperating members are of a one piece construction molded from plastic.

11. An apparatus, comprising:

a housing having an upstream area and a downstream area; said housing also having an exit slot therein located at said downstream area through which a document can exit said housing;

a document feeding mechanism located at said upstream area;

a document transport module operatively located between said document feeding mechanism and said exit slot for transporting the document from said document feeding mechanism at said upstream area to said housing exit slot at said downstream area; and said document transport module comprising:

first and second supports a cooperating member located on said first support, said cooperating member having an arcuately shaped recessed portion therein; said cooperating member comprising:

first and second member ends located relative to said upstream and downstream areas, respectively;

first and second ramp portions located on said first and second member ends, respectively, of said cooperating member for guiding the document towards and away from said arcuately shaped recessed portion;

drive means located on said second support for moving the document into engagement with said arcuately shaped recessed portion and also for moving the document from said document feeding mechanism to said exit slot of said housing;

said drive means including a drive roller with said arcuately shaped recessed portion confirming generally in shape to a portion of said drive roller for driving the document into engagement with said arcuately shaped recessed portion;

said first support member further including a second cooperating member having an arcuately shaped recessed portion therein with said first drive means moving the document into simultaneous engagement with said arcuately shaped recessed portion of said cooperating member and said arcuately shaped recessed portion of said second cooperating member when the document is moved towards said housing exit slot;

third and fourth cooperating members located on said first support, said third and fourth cooperating members each having an arcuately shaped recessed portion therein; and a second drive means for moving the document into simultaneous engagement with said arcuately shaped recessed portions of said third and fourth cooperating members and also for moving the document towards said housing exit slot.

12. The apparatus as claimed in claim 11 in which said first and second supports each has a first end;

said document transport module further including:

pivot means for pivotally securing said first ends of said first and second supports together to enable the first and second supports to pivot between an open position and a closed position.

13. The apparatus as claimed in claim 11 in which the document transport module further comprises:

securing means for securing the first and second supports in said closed position;

said securing means comprising:

first and second resilient detents which depend from said second end of said first support; and said second end of said second support having first and second apertures therein to coact with said first and second resilient detents, respectively, to secure said first and second supports in said closed position.

* * * * *